US005283914A

United States Patent [19]

James

[11] Patent Number: 5,283,914

[45] Date of Patent: Feb. 8, 1994

[54] PROTECTIVE HELMETS

[75] Inventor: Granville C. James, Ashby-de-la-Zouch, England

[73] Assignee: Coal Industry (Patents) Limited, London, England

[21] Appl. No.: 959,103

[22] Filed: Oct. 9, 1992

Related U.S. Application Data

[63] Continuation-in-part of Ser. No. 810,909, Dec. 20, 1991.

[51] Int. Cl.[5] ..... A42B 3/00

[52] U.S. Cl. ..... 2/424; 2/171.3; 128/201.24; 128/201.25

[58] Field of Search ..... 2/410, 422, 423, 424, 2/171.3; 128/201.24, 201.25

[56] References Cited

U.S. PATENT DOCUMENTS

| | | | |
|---|---|---|---|
| 3,178,723 | 4/1965 | Aileo . | |
| 3,223,086 | 12/1965 | Denton . | |
| 3,239,842 | 3/1966 | Marchello | 2/422 |
| 3,310,811 | 3/1967 | Lacono . | |
| 3,736,927 | 6/1973 | Misaqi . | |
| 3,906,547 | 9/1975 | Aileo . | |
| 3,963,021 | 6/1976 | Bancroft | 2/171.3 |
| 4,103,359 | 8/1978 | Rieppel et al. | 2/423 |
| 4,133,308 | 1/1979 | Lowe et al. | 2/171.3 |
| 4,136,688 | 1/1979 | Gorman | 2/171.3 |
| 4,227,520 | 10/1980 | Lord | 128/201.24 |
| 4,280,491 | 7/1981 | Berg et al. | 2/171.3 |
| 4,752,974 | 6/1988 | Haino | 2/171.3 |
| 4,852,562 | 8/1989 | Howie | 2/171.3 |

FOREIGN PATENT DOCUMENTS

| | | | |
|---|---|---|---|
| 3220691 | 12/1983 | Fed. Rep. of Germany . | |
| 2629986 | 10/1989 | France . | |
| US8100244 | 2/1981 | PCT Int'l Appl. . | |
| 1005187 | 9/1965 | United Kingdom . | |
| 1005188 | 9/1965 | United Kingdom . | |
| 1456956 | 12/1976 | United Kingdom . | |
| 1495020 | 12/1977 | United Kingdom . | |
| 1525090 | 9/1978 | United Kingdom . | |
| 2014036 | 8/1979 | United Kingdom . | |
| 2061696 | 5/1981 | United Kingdom | 2/410 |
| 2063074 | 6/1981 | United Kingdom . | |
| 2103467 | 2/1983 | United Kingdom | 2/410 |
| 2152702 | 8/1985 | United Kingdom | 2/424 |

OTHER PUBLICATIONS

G. K. Greenough, "The Dust Helmet", Safety in Mines Research Development, pp. 8–12 (U.K. 1974).

*Primary Examiner*—Clifford D. Crowder
*Assistant Examiner*—Michael A. Neas
*Attorney, Agent, or Firm*—James Creighton Wray

[57] ABSTRACT

A protective helmet incorporates a visor retractable therewithin, a fan for providing filtered airflow through a duct within the shell to the visor, and ear defenders mounted substantially within the profile of the shell.

20 Claims, 4 Drawing Sheets

PROTECTIVE HELMETS

This application is a continuation-in-part of application Ser. No. 810,909 filed Dec. 20, 1991.

BACKGROUND OF THE INVENTION

This invention concerns improvements in or relating to protective helmets for use by operatives in industrial environments.

In particular, although not exclusively, the invention has reference to such helmets for use in the mining or quarrying industries wherein the need for protective headwear is especially acute. Protection is required not only to prevent physical injury but also to avoid and indeed minimise damage to the respiratory organs, to the aural, ocular and olfactory senses.

Protective helmets in the form of powered helmet respirators are already known and generally include a protective shell within which is provided means for introducing a filtered air supply between the wearer's face and a visor which may assume a fixed disposition on the shell or may be pivotally mounted outside the shell to allow movement into and out of an operable, i.e. protective, position in front of a wearer's face.

It is also known to provide protective helmets with ear defenders mounted externally of the shell and pivotable between operative and inoperative positions. The problem is that because of their location exteriorly of the shell, they can become snagged on equipment which occasions discomfort to the wearer, and damage or dislodgement of the ear defender.

It has been and remains a feature of known powered helmet respirators that they are cumbersome and also heavy and poorly balanced when provided with respirator fans and filter, face visor and ear defenders, with consequential user resistance.

It is therefore an object of the present invention to provide an improved protective helmet.

SUMMARY OF THE INVENTION

According to the invention there is provided a protective helmet including a protective shell for accommodating a wearer's head, a visor at the front part of the shell and retractable therewithin, the shell being provided with an ear defender at each side thereof, each ear defender being substantially within the profile of the shell, an air duct defined within the shell and having an inlet towards the rear part of the shell and a number of outlets associated with the front part of the shell and directed on to the internal surface of the visor and at least some of its marginal edges which in use extend adjacent the wearer's face, a filter associated with the duct, and an air mover for introducing air to the duct.

Advantageously the air duct extends from the occipital region to terminate at the front part of the shell in the or each outlet which in use supplies air to the top part of the visor when in its operational extended position in front of a wearer's face, such that the interior of the visor is swept with air. Preferably there is provided a plurality of outlets for the air duct, the outlets being directed such as in use to sweep the interior of the visor with air and to target the marginal edges of the visor lying adjacent the wearer's face thereby to provide a pneumatic seal therearound to minimise the ingress of injurious atmospheric pollutants.

An inner protective skin is disposed within the shell in spaced relation thereto, the skin conveniently defining the duct between it and the internal surface of the shell. The air duct extends over a substantial part of its length between the shell and the inner skin, the inner skin being bifurcated at the front part of the shell to provide both the number of outlets and the space for visor retraction.

The shell may be formed to give at its rear part an outer wall and at its front part an inner wall, the front part being provided with a cover to define a channel within which the visor may retract. The cover in such an embodiment is so formed as to give the helmet a continuous or substantially continuous outer profile. The cover may for convenience be removable and replaceable, suitable fixtures being provided for that purpose.

The filter may conveniently extend across the inlet to the duct, and the air mover may be disposed within the duct in rearwards of the crown of the shell. The air mover is constituted by at least one fan, preferably battery powered.

The visor may be removably mounted in a carrier having a renewable transparent section constituting the visor per se. Alternatively, the carrier may comprise a frame into which a renewable transparent section may be insertable.

The visor carrier may be slidably mounted to the interior of the shell by means of side supports each having slots with which bushes on the carrier engage to afford in use an arcuate sliding motion for the visor into and out of an operative position in front of the wearer's face.

Each ear defender may conveniently be provided substantially within the profile of the helmet thereby to secure that there are no protuberances which in use could constitute a source of danger by snagging.

The front part of the shell may be peaked and be provided with protective side cheeks which in use complement the visor and the ear defenders to provide continuity around the wearer's face. The side cheeks form a proximity seal between the visor frame and the wearer's face, thus providing enhanced protection from side draughts of contaminated air.

The front part of the shell may be provided with a mount for a lamp such as is used in underground mining, the lamp being battery powered. In the one embodiment described above, the cover would be provided with the mount at the front of the helmet. The removable cover provides a degree of versatility whereby different fitments thereto can be provided on a range of covers.

By way of example only, one embodiment of protective helmet according to the invention is described below with reference to the accompanying drawings in which:

DETAILED DESCRIPTION OF THE DRAWINGS

Figure 1:
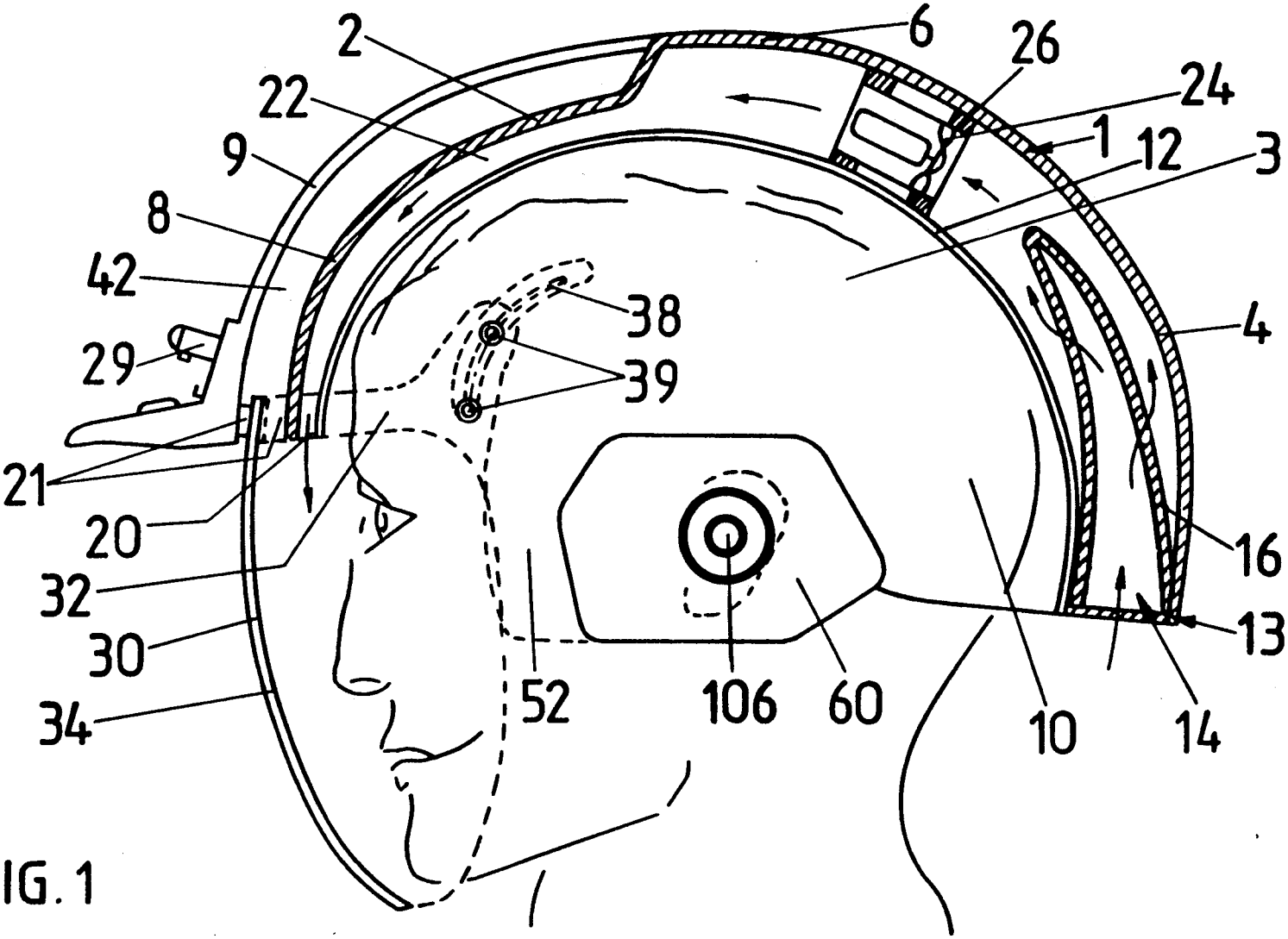
FIG. 1 is a side view of the helmet partly in section and in position on a wearer's head.
Figure 2:
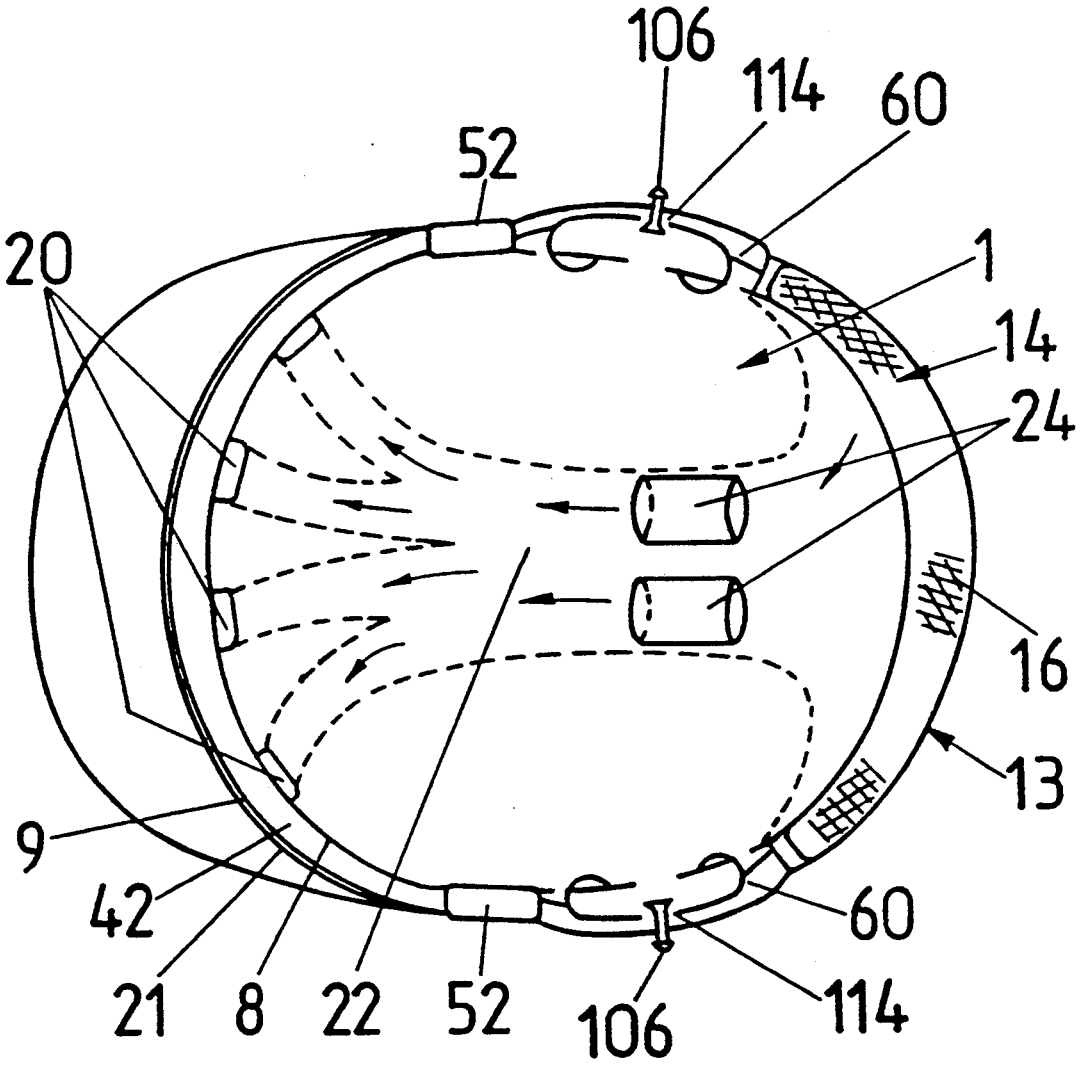
FIG. 2 is an interior view of the helmet.

Referring to FIGS. 1 and 2 of the drawings, there is shown at 1 a protective helmet in the form of a powered helmet respirator in position on a wearer's head 3, the respirator comprising a protective shell 2 having a rear part 4, a crown 6, a front part 8 and sides 10. A head harness (not shown) is provided within the shell 2 for comfortably seating the respirator on the wearer's head 3.

An inner skin 12 extends from the rear part 4 to the front part 8 and defines in the occipital region an air inlet 14 across which there is provided a filter 16 of suitable fibrous material. The filter 16 is clipped into a holder 13 and can thus be easily dismountable and replaceable.

A further inner skin which comprises parts of the shell 4, 6, 8 extends through 4, 6 and downwards through 8 terminating in a plurality of outlets 20 in the form of slots. An air duct 22 is thus defined within the shell 2 between its inner surface and the skins 12 and 4, 6 and 8.

A front cover 9 is fixed to the shell 2 to provide a smooth profile to the helmet exterior and with the front part of the protective shell 8, provides a space 42 into which the visor 30 may retract.

An air mover in the form of two battery-powered fans 24 is located within the duct 22 on sound-absorbing mounts 26 rearwards of the crown 6 of the shell 2. The power for the fans 24 is conveniently provided by a body mounted battery pack (not shown) which is of such capacity as additionally to power a lamp (not shown) releasably fixable to the front part 9 on a bracket 29 provided for that purpose (FIG. 1).

A visor 30 comprising a carrier 32 which is releasably fixed to a transparent window 34 is slidably and pivotally mounted on supports 38 fixed to the sides of the helmet shell 2, with bushes 39 attached to the visor carrier 32. The supports 38 have curved slots within which the bushes are adapted to slide.

The visor 30 is retractable within a space 42 defined between part 8 of the shell 2 and the inside wall of the outer cover 9. The visor 30 has a stop for abutting a cut-off switch (not shown) such that when the visor is fully extended in front of the wearer's face, the power to the fan 24 is initiated. Additionally, in this position, the visor is sealed against the inner face of the outer cover 9 by a sealing strip 21. The visor may alternatively seal against the outer face of the shell 8 along its lower edge. A limited pivoting motion about the lower bush 39 may be provided to enable the lower part of the visor to move closer to the wearer's face, and is achieved by a small recess in the slot in the support 38 into which the upper bush may move. In its operative position as shown in FIG. 1, the visor 30 in conjunction with cheek plates 52 and ear defenders 60, to be described later, on the sides 10 of the shell 2 gives panoramic protection for the front and sides of the wearer's face.

The visor 30 may be provided with a range of proximity seals (not shown) to reduce the distance between the visor margins and the wearer's face for the purpose of further minimising the ingress of contaminated air into the wearer's breathing zone.

With reference to FIG. 1, there is shown on one side of the powered helmet respirator 1 an ear defender 60 which is secured to the shell 2. A corresponding ear defender (not shown) is provided on the other side of the shell. The ear defender 60 conforms to the general profile of the helmet 1.

Figure 3:
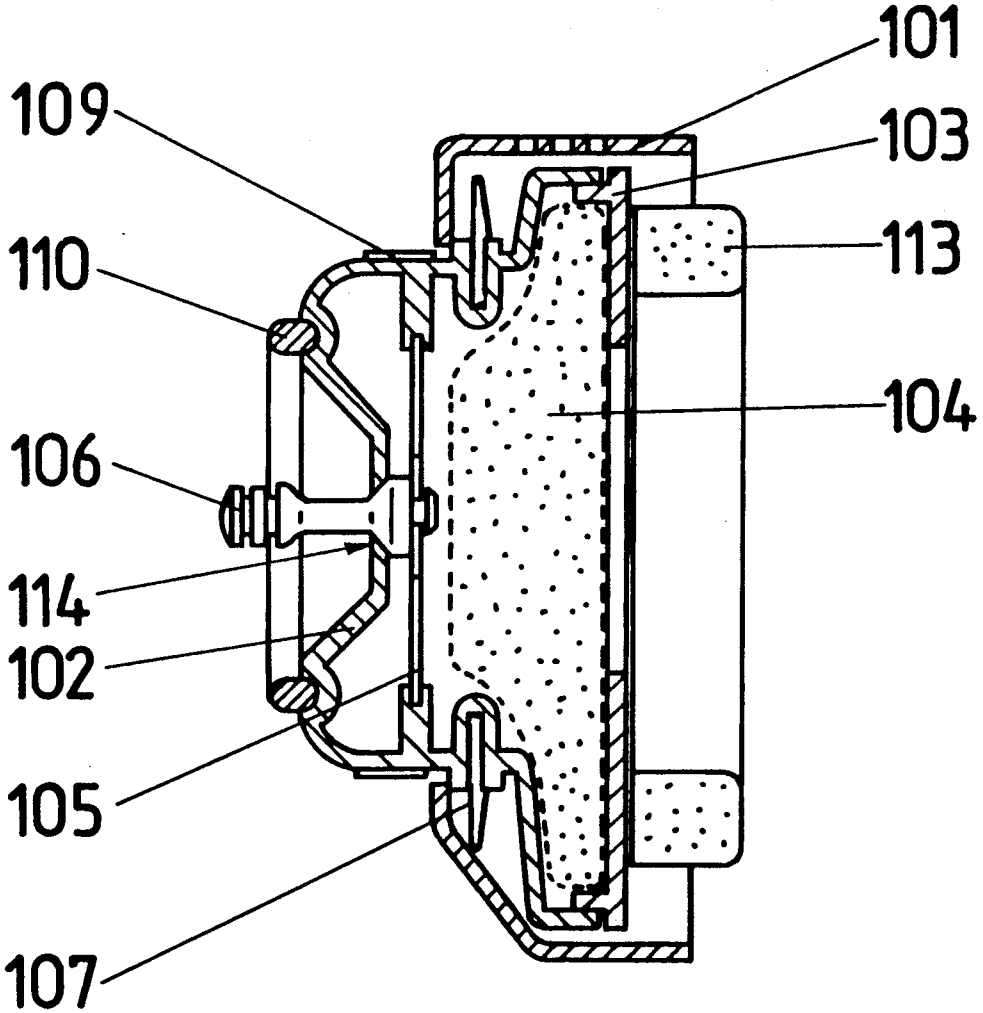
FIG. 3 is a vertical section through the centre line of an ear defender of the helmet.
Figure 4:
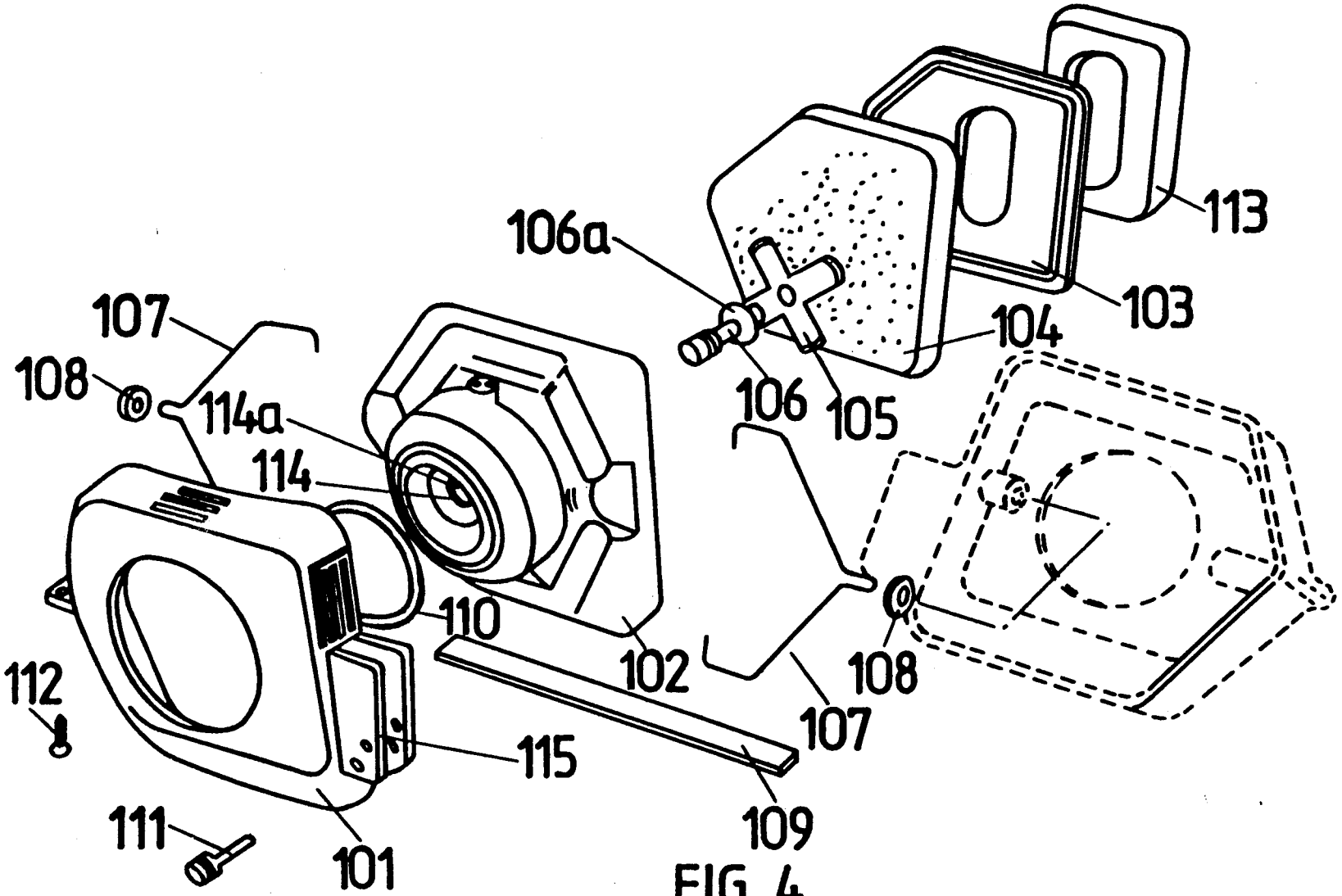
FIG. 4 is an exploded view of the ear defender shown in FIG. 3.

Referring now more specifically to FIGS. 3 and 4, each ear defender 60 includes an outer cover 101 provided to form an attachment to the helmet 1 and to contain a main body shell 102 of the defender. The main body shell 102 is attached in spaced relation to an apertured back plate 103 enclosing sound absorbing material 104 therebetween.

A cruciform spring 105 is held in position within the body shell 102 and is engaged by a telephone activator/-release knob 106 provided with a sealing face 106*a* for abutting a seat 114 formed around an orifice 114*a* extending axially through the body shell 102, the arrangement being such that when the knob 106 is depressed against the action of the spring 105, the orifice 114*a* is opened allowing sound to pass inwardly of the ear defender in use towards the ear of a helmet wearer through the apertured back plate 103. Release of pressure on the knob 106 allows the spring 105 to return the knob to a sealing position in relation to the orifice 114*a* thereby restoring the ear defender to its noise attenuating role.

An ear seal 113 is secured to the backplate 103 in a position comfortable to the wearer, and forms a contact seal with that part of the wearer's head immediately surrounding the ear.

Wire-form springs 107 support the body shell 102 inside the outer cover 101 such that when the body shell 102 is pushed into the cover 101, the springs 107 hold the shell 102 therein using the 'over centre' principle. When the body shell 102 is pushed in the opposite direction, the springs 107 press the ear defender seal 113 against the wearer's head with the correct pressure for providing noise attenuation. The springs 107 are attached to the outer cover 101 using vibration dampers 108.

In use, in order permit the use of a telephone, the telephone earpiece (not shown) is brought into contact with the knob 106 and pressure applied sufficiently to depress the spring 105 and thus open the orifice 114*a*. The outer part of the telephone earpiece is pressed against a seal 110 provided on the body shell 102 to exclude external noise. In this mode, sound from the telephone ear piece is transmitted via the orifice 114*a*, through the body shell 102 and the apertured backplate 103 to the wearer's ear. Removal of the telephone earpiece from contact with the knob 106 automatically allows the ear defender to revert to its full attenuation mode.

A reflective strip 109 is wrapped around that part of the body shell 102 such that when the ear defender is in its non-operative (parked) position, when no sound attenuation is effected, the reflective strip is visible externally of the outer cover 101. When the ear defender is in its operative position, the reflective strip 109 is not readily visible.

The outer cover 101 is fitted with means for attachment to a helmet in one of several positions to suit the width of the wearer's head. The attachment may be effected by screws 112 or by any other suitable means.

The relatively forward part of the outer cover 101 is provided with a pair of tabs 115 having a series of holes capable of accepting a visor stop peg 111. The peg 111 is secured into a pair of holes best suited to the wearer to provide a comfortable and effective position for holding the visor close to, but not in contact with the wearer's face.

In use, the helmet 1 fits snugly and comfortably on the wearer's head 3 initially with the visor 30 in its retracted position within the space 42, the fans 24 being stationary. Downward movement of the visor 30 brings it into its operative position as shown in FIG. 1. At the same time release of the cut-off switch (not shown) allows power to be restored to the fans 24 which accordingly induce an air flow through the inlet 14 and the filter 16 into the duct 22 and thence to the outlets 20 whence it travels downwards between the visor 34 and the face of the wearer to ventilate same with filtered air and to provide cooling. By virtue of the slot form of the outlets 20 and the close fitting of the visor 30 with the cheek plates 52 and ear defenders 60, a screen of air passes in a concentrated flow over the nose and mouth of the wearer, the air flow passing out between the lower margins of the visor 30 and the wearer's chin, and lower parts of the cheeks.

The ear defenders 60 are within the general profile of the shell 2 of the helmet 1, and present no projection likely to be a hazard. Operation of a fully integrated and custom designed helmet according to the present invention in which the ear defenders are within the profile of the shell enables noise attenuation to be achieved effectively.

The present invention thus provides a comprehensive and versatile powered helmet respirator possessing an optimum of protective features whilst being less cumbersome and less weighty than its antecedents. Equally, replacement of the filter and of the visor window are facilitated thus reducing cost and time spent in repair.

I claim:

1. A protective helmet including a protective shell for accommodating a wearer's head, a visor at the front part of the shell and retractable therewithin, an ear defender at each side thereof at each side of the shell, each ear defender being substantially within the profile of the shell, an air duct defined within the shell, an inlet means to the duct towards the rear part of the shell and a number of outlet means associated with the front part of the shell and directed on to the internal surface of the visor and at least some of its marginal edges which in use extend adjacent the wearer's face, a filter associated with the duct, and an air mover for introducing air to the duct, wherein the front part of the shell is provided with protective side cheeks which in use complement the visor and the ear defenders to provide continuity around the wearer's face.

2. A helmet according to claim 1 in which the air duct extends from the occipital region of the helmet to terminate at the front part of the shell in each outlet means which in use is adapted to supply air to the top part of the visor when in its operational extended position in front of a wearer's, such that the interior of the visor is swept with air.

3. A helmet according to claim 1 in which there is provided a plurality of outlet means for the air duct, the outlet means being directed such as in use to sweep the interior of the visor with air and to target the marginal edges of the visor lying adjacent the wearer's face.

4. A helmet according to claim 1 in which the filter extends across the inlet means to the duct.

5. A helmet according to claim 1 in which the air mover is constituted by at least one fan.

6. A helmet according to claim 1 in which the visor includes a carrier to which a transparent section is detachably fixed.

7. A helmet according to claim 1 in which the visor is slidably mounted to the interior of the shell by means of at least one support arm.

8. A helmet according to claim 1 in which each ear defender is attached to the shell, the defenders having parts for moving a portion of each defender between non-operating and operating positions.

9. A helmet according to claim 8 in which the ear defender in its operating position in use contacts the otic region of a wearer.

10. A helmet according to claim 9 in which an inner part of the ear defender is caused to contact the otic region mechanically by operating a releasable means attached to the ear defender.

11. A helmet according to claim 9 in which the ear defenders in their operating position in contact with the otic region prevent or allow the passage of sound therethrough.

12. A helmet according to claim 11 in which pressure applied to the parts of the ear defenders opens sound transmission passageways therewithin thereby allowing the passage of sound.

13. A helmet according to claim 12 in which each ear defender is provided with an outer cover attachable to a side of the helmet, a body shell mounted within the outer cover for movement between operational and non-operational positions, a sound transmitting means provided in the body shell, a resiliently biased means for sealing the sound transmitting means, and sound absorbing material provided within the body shell.

14. A helmet according to claim 13 in which the mounting of the body shell within the outer cover is effected by means of wireform springs.

15. A helmet according to claim 13 in which the resilient bias comprises a cruciform spring mounted in the body shell.

16. A helmet according to claim 13 in which the means for sealing the sound transmitting means is an actuating knob provided with a sealing face for abutting a seat formed around the sound transmitting means.

17. A helmet according to claim 1 in which the front part of the helmet is provided with a mount for a lamp.

18. A helmet according to claim 1 in which the air mover is battery-powered.

19. A protective helmet including a protective shell for accommodating a wearer's head, a visor at the front part of the shell and retractable therewithin, an ear defender at each side thereof at each side of the shell, each ear defender being substantially within the profile of the shell, an air duct defined within the shell, an inlet means to the duct towards the rear part of the shell and a number of outlet means associated with the front part of the shell and directed on to the internal surface of the visor and at least some of its marginal edges which in use extend adjacent the wearer's face, a filter associated with the duct, and an air mover for introducing air to the duct, wherein the shell provides at its rear part of the outer profile of the helmet and is stepped at its front part, a removable cover being provided in spaced relation to the front part to define a space into which the visor is retractable and being continuous with the profile of the helmet.

20. A protective helmet including a protective shell for accommodating a wearer's head, a visor at the front part of the shell and retractable therewithin, an ear defender at each side thereof at each side of the shell, each ear defender being substantially within the profile of the shell, an air duct defined within the shell, an inlet means to the duct towards the rear part of the shell and a number of outlet means associated with the front part of the shell and directed on to the internal surface of the visor and at least some of its marginal edges which in use extend adjacent the wearer's face, a filter associated with the duct, and an air mover for introducing air to the duct, wherein the air mover is disposed within the duct to the rear of the crown of the shell and downstream of the filter.

* * * * *